US006869039B2

(12) United States Patent
Koutonen

(10) Patent No.: US 6,869,039 B2
(45) Date of Patent: Mar. 22, 2005

(54) METHOD AND APPARATUS FOR WINDING A PAPER WEB

(75) Inventor: Pauli Koutonen, Jokela (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/905,550

(22) Filed: Jul. 13, 2001

(65) Prior Publication Data

US 2002/0017586 A1 Feb. 14, 2002

Related U.S. Application Data

(63) Continuation of application No. PCT/FI00/00041, filed on Jan. 19, 2000.

(30) Foreign Application Priority Data

Jan. 22, 1999 (FI) ..... 990124

(51) Int. Cl.[7] ..... B65H 35/02

(52) U.S. Cl. ..... 242/524.1; 242/525.5; 242/530; 242/530.1

(58) Field of Search ..... 242/524.1, 525.5, 242/525.6, 536.1, 530

(56) References Cited

U.S. PATENT DOCUMENTS

| | | | | |
|---|---|---|---|---|
| 3,257,882 A | | 6/1966 | Lulle et al. | |
| 3,587,374 A | | 6/1971 | Stewart et al. | |
| 3,651,723 A | | 3/1972 | Gallagher et al. | |
| 3,961,547 A | | 6/1976 | Shainberg et al. | |
| 4,398,678 A | | 8/1983 | Kron et al. | |
| 4,484,500 A | | 11/1984 | Reba et al. | |
| 4,516,454 A | | 5/1985 | Mosburger | |
| 4,548,105 A | | 10/1985 | Koutonen | |
| 4,629,139 A | | 12/1986 | Sanda et al. | |
| 4,697,755 A | | 10/1987 | Kataoka | |
| 4,746,076 A | | 5/1988 | Tomma et al. | |
| 4,846,416 A | | 7/1989 | Natale | |
| 5,217,177 A | * | 6/1993 | Stefanoni | 242/525.5 |
| 5,251,835 A | | 10/1993 | Kyytsönen | |
| 5,363,730 A | | 11/1994 | Besemann | |
| 5,620,151 A | | 4/1997 | Ueyama et al. | |
| 5,954,291 A | | 9/1999 | Meinecke et al. | |
| 6,286,404 B1 | | 9/2001 | Miglietta | |

FOREIGN PATENT DOCUMENTS

| | | |
|---|---|---|
| EP | 0 380 438 A1 | 1/1990 |
| EP | 0 685 304 A1 | 6/1995 |
| EP | 0 894 583 A2 | 7/1998 |
| FI | 854571 | 11/1985 |
| FI | 905284 | 10/1990 |
| WO | WO 96/37429 | 11/1996 |
| WO | WO 97/35696 A1 | 10/1997 |

* cited by examiner

*Primary Examiner*—John Q. Nguyen
(74) *Attorney, Agent, or Firm*—Stiennon & Stiennon

(57) ABSTRACT

A paper web (W) is longitudinally divided into slit webs of desired widths and the slit webs are wound into rolls (R) about roll cores (H) at a winding station (17A, 17B). The web is cut by a web-severing device (16) in conjunction with the roll set change of the winding operation. At least two slitter assemblies (15A, 15B) are employed for slitting the web (W) and, when given ones of the slitter assemblies (15A, 15B) are slitting the web (W) into one set of slit webs, the desired ones of the other slitter assemblies (15A, 15B) are preset into desired slitting width positions for slitting the next set of slit webs. The winding apparatus has slitter assemblies (15) for longitudinally dividing a web (W) into slit webs and a winding station (17A; 17B) for winding the slit webs into rolls (R) and a web-severing device for cutting the web.

16 Claims, 1 Drawing Sheet

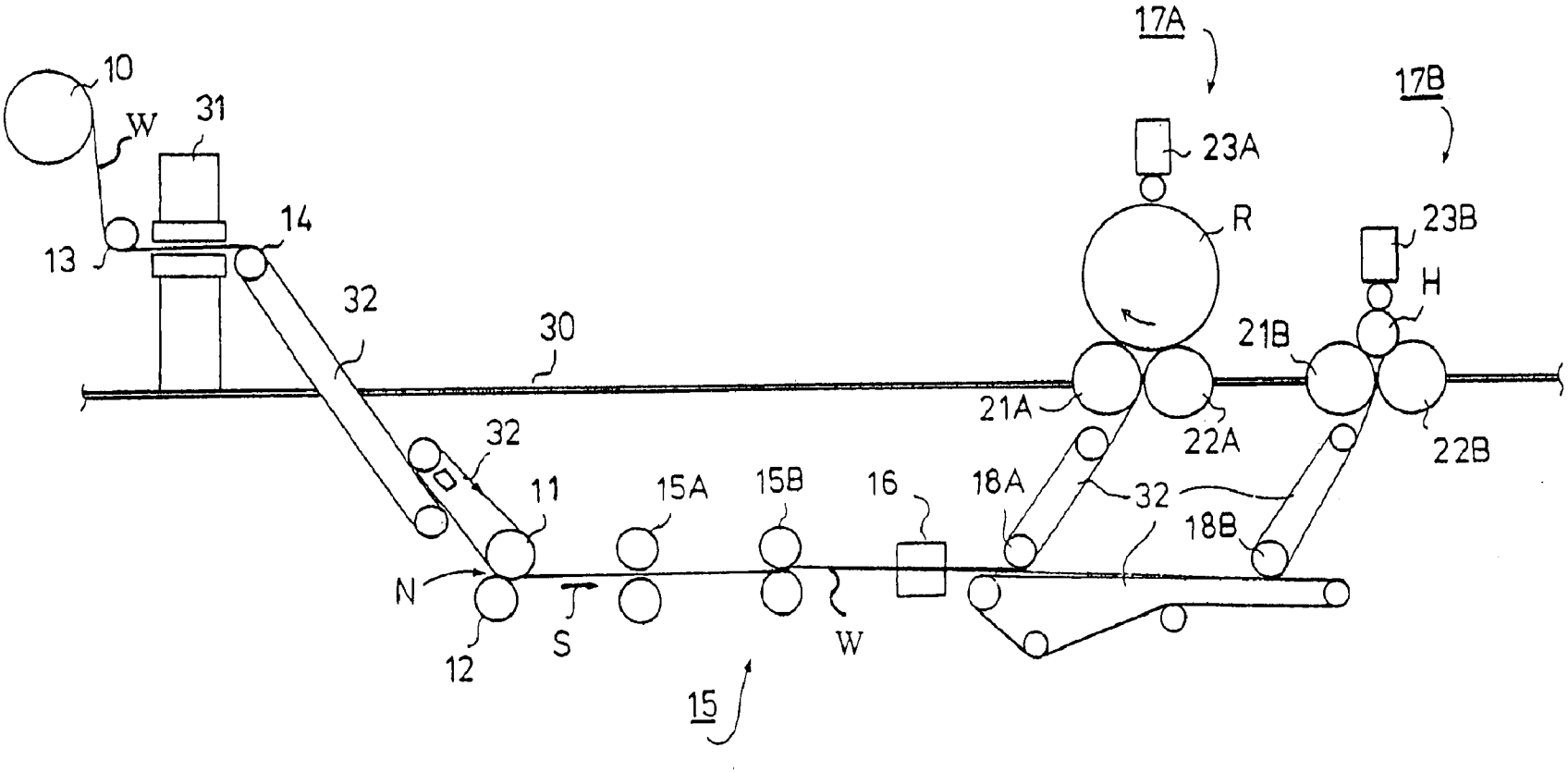
17B
23B
H
22B
21B
17A
23A
R
22A
18B
32
21A
18A
16
W
15B
15
15A
S
30
11
32
12
N
32
14
31
W
10
13

METHOD AND APPARATUS FOR WINDING A PAPER WEB

CROSS REFERENCES TO RELATED APPLICATIONS

This application is a continuation of PCT/FI00/0041, filed Jan. 19, 2000, and claims priority on Finnish Application No. 990124, Filed Jan. 22, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

BACKGROUND OF THE INVENTION

The present invention relates to a method for winding a paper web, in which method the web is longitudinally divided into slit webs of desired widths and the slit webs are wound into rolls about roll cores or similar centers at a winding station and in which method the web is severed by means of a web-severing device in conjunction with the roll set change of the winding operation.

The invention also concerns an apparatus for use in paper web winding, said apparatus including slitter assemblies for longitudinally dividing the web into slit webs of desired widths and a winding station for winding the slit webs into rolls and a web-severing device for cutting the web.

In the art of papermaking, a variety of different winder constructions are known for specific applications. One winder embodiment is described in FI Patent No. 91383 disclosing a so-called center-reeler-type slitter-winder apparatus. Various types of winders are also known from slitter constructions, one embodiment being described in FI Patent No. 74260, for instance.

In the international patent application publication WO96/37429, there is disclosed a winder apparatus suited for winding a paper web immediately at the end of a papermaking process or, alternatively, for being integrated with a Pope winder of a papermaking machine. The apparatus comprises slitter means and one or two winding stations for winding webs slit from a machine-wide web. During a roll set change, this kind of device permits the web slitting operation to be temporary halted or the slit web to be severed individually. Cited publication also teaches the possibility of using a plurality of winding stations. One problem hampering this prior-art embodiment is that the web must be dumped into the pulper for a certain time during a roll set change and slitting width adjustment operation. On the other hand, further problems arise as broke will result for some time during roll set change due to the fact that driving the slitter blades into a new position unavoidably takes a certain time during which no usable web is produced.

EP application publication 0380438 discloses a web slitter and groover system for forming first and second spaced circular grooves in a roll product, said system including first and second web cutting assemblies alternately and sequentially movable to form web segments of diminished width along spaced portions thereof which, when wound, form the grooves.

SUMMARY OF THE INVENTION

It is an object of the present invention to provide a method and an apparatus suited for use in winding a paper web, said method and apparatus also or particularly being suitable for use in on-line winding immediately at the end of a papermaking process. It is a further object of the invention to provide a method and apparatus for winding a paper web in a manner eliminating broke during roll set change and offering an entire elimination of or at least a minimized disturbance from the above-described problematic factors.

To achieve the above goals and others defined later in the text, the method according to the invention is principally characterized in that the number of slitter assemblies employed in the method is at least two and that when given ones of the slitter assemblies are slitting the web into a set of slit webs, the desired ones of the other slitter assemblies are preset into desired slitting width positions for slitting the next set of slit webs.

According to a preferred embodiment of the invention, a first slitter assembly is driven open during the roll set change operation in order to run a desired length of a machine-wide web, after which a second slitter assembly is driven into its operating position for slitting the machine-wide web into slit webs for winding into rolls at the winding station, said steps being carried out at least in the case that the next set of rolls is desired to include rolls with widths different from those of the preceding roll set.

Furthermore, the apparatus according to the invention is principally characterized by including at least two slitter assemblies which are adjustable in advance to the next slitting width to change the width at full speed.

Accordingly, the invention employs two slitter assemblies disposed in a succession along the travel direction of the web, whereby it is possible during a roll set change to slit two different roll sizes without baiting the winding operation or running the web into a pulper. When one slitter assembly is slitting the paper web into slit webs, the other assembly can be trimmed into desired set positions, wherein the slitter blade units of the slitter assembly are adjusted into desired cross-machine slitting positions to produce slit webs of desired widths, after which the first slitter assembly is driven open during the roll set change while the second slitter assembly is driven into its operating position with its slitter units preset to desired slitting widths. Hence, the amount of broke occurring during roll set change is minimized to zero.

When the rolls at the winding station are full requiring roll set change onto new cores, the slitter assemblies are driven into their open positions and the station is run for a while with a full-width web, whereby the full-width web can be used for attaching thereto advantageously a glue stripe, tape or the like with which the leading tail of new slit webs is adhered to cores, and the desired slitter assembly is subsequently driven into its slitting position thus allowing the winding operation to be continued. The webs are passed to the winding stations with the help of conventional guiding means such as support belts/fabrics, air-foil supports and the like assemblies.

According to the invention, the web is most advantageously cut using an obliquely across the web severing device, but also a severing device cutting at right angles to the web travel direction is applicable.

The method and apparatus according to the invention are particularly suitable for use in papermaking lines, where the web is passed directly from the papermaking machine to the winding station of customer rolls thus disposing with the winder/rewinder equipment conventionally required at the end of a papermaking line. In the present system, the papermaking machine is provided with a drawing nip that precedes the apparatus according to the invention, whereby the nip is immediately followed by the slitter assemblies, the web severing means and the winding stations.

The arrangement according to the invention facilitates continuous web winding without any need to halt the papermaking machine or the winding station and the paper web need not be dumped into the pulper during roll set change.

According to the invention, two slitter assemblies adapted in succession are used in order to change the slitting width settings in a smoothly continuous manner during roll set change. The web slitting function is switched off during roll set change for a short time in order to assure faultless web severing and to insert new cores, whereby the apparatus runs temporarily with a full-width web to which according to an advantageous exemplifying embodiment of the invention is adhered glue or tape in order to attach the web tails to the new cores and over which full-width area the web can be severed. The second winding station and the new cores is are accelerated, to a synchronous speed with the web prior to severing the web off from the first winding station.

The slitting station comprises two successive slitter assemblies, both of them having a separate set of blades, thus permitting the next slitting width adjustment to be made in advance, whereby the slitting width change can be at full speed.

In conjunction with the roll set change during the winding operation, the web is cut most advantageously with the help of a severing means operating obliquely across the web. The obliquely-severing device is complemented with a glueing device, by means of which glue is applied to the leading tail of the web, at a suitable distance from the tail tip to secure the run of the web tail about the core. During roll set change, the blades of both slitter assemblies are temporarily withdrawn away from the web to provide a proper length of full-width web such that makes it easier to transfer the web tail to the second winding station.

The web is transferred in a controlled manner from one winding station to the other with the help of support bands, support belt assemblies operating with full-width or narrow belts and/or air-foil guides and turns and/or air jet/suction guide assemblies that act either directly on the web or, alternatively, via rolls.

After severing, the web is transferred with the machine running at full speed to the second winding station having the cores already mounted thereto and the station preaccelerated to a synchronous speed with the web speed prior to severing the web.

After severing the web, the winding station having the full rolls is decelerated in a conventional manner, the roll set change is made, the new cores are placed and the station is controlled ready for the next roll set change.

The web severing device can be disposed directly on the papermaking line so as to, e.g., replace a conventional winder in any conventional papermaking machine or on-line equipment combination. Additionally, a winding station can be used having a so-called flying change of reeling drum as is known from coating equipment, for instance.

When desired, the invention can be adapted for use in conjunction with a conventional winder apparatus requiring, however, the web-severing device to be stopped during the change of the reeling drum.

In the following the invention is described in greater detail with reference to the appended diagram showing an exemplifying embodiment of the invention.

BRIEF DESCRIPTION OF THE DRAWINGS

The FIGURE is a side elevational schematic view of a paper winder and splitter of this invention.

DESCRIPTION OF THE PREFERRED EMBODIMENTS

In the embodiment shown in the appended diagram, a paper web W is passed from the last dryer cylinder 10 of a papermaking machine through a gauging frame 31 and via a drawing nip N formed by rolls 11 and 12 and supported by guide rolls 13 and 14 to a slitter apparatus 15. The gauging frame 31 may be followed by, e.g., a calender or other web-finishing apparatus. In the embodiment according to the invention illustrated in the diagram, slitter apparatus 15 includes two slitter assemblies 15A, 15B disposed in a succession in the downstream travel direction S of the web W, whereby the diagram illustrates the operating position of slitter assembly 15B with which the web W is being slit longitudinally into narrower webs of desired widths. Next after the slitter apparatus 15, the web W is passed via a web-severing unit 16 and supported by a guide roll 18A to a winder apparatus 17A comprised of support rolls 21A,22A and a surface-press roll device 23A and in which the roll R is wound. Obviously, the second winding station 17B, to which the web W is passed supported by a guide roll 18B, obviously is correspondingly comprised of support rolls 21B,22B and a surface-press roll device 23B as well as a core H placed in the winding station during the winding operation shown in the diagram. As shown in the diagram, the web threading means may include guide/support belts or wires 32, but the web threading in the apparatus embodiments according to the invention may as well use, e.g., air-foil guiding means and other similar web-threading devices familiar to those versed in the art.

Prior to roll set change, one slitter assembly 15A is adjusted to desired slitting widths, whereby the blades of the slitter assembly are set into desired lateral positions, after which the operating slitter assembly 15B can be driven open and the slitter assembly 15A with its desired settings can be driven into its operating position. During roll set change in the winding station, both slitter assemblies 15A, 15B are driven into their open positions for a short time during which the web is not being slit, but rather, the web W runs in full width and then the web W is severed at the web-severing unit 16 at said full-width point and, if so desired, the web-severing unit 16 is provided with a glueing device or similar means serving to apply glue or the like adhesive for attaching the tails of the slit webs W to the cores H. Before the roll set change, the cores H at the second winding station 17B are already driven to a synchronous speed with the speed of the web W. After the roll set change, the second winding station 17A having the finished rolls resting thereon is slowed down, the finished rolls are removed, the new cores are located in place and the station is controlled ready for the next roll set change.

It must be understood that, while the above description illustrates the two slitter assemblies as if disposed in two separate assemblies that are located in-line in two different positions, obviously different sets of rolls can be finished using slitter blades which are physically situated in separate assemblies provided that a given severing point of the web in the successive sets of rolls remains unchanged. Slitter blades located in separate assemblies must anyhow be used, e.g., when the new severing point of the web in successive sets must be displaced only slightly from the preceding severing point, yet being so close that the adjacent (free) slitter blade of the same assembly cannot be physically adapted to slit at the same point. Nevertheless, the basic concept of the invention remains the same, namely: the position of the slitter blades for the next set can be preset by adjusting the free blades to preset new positions.

It must be understood that the invention is by no means limited to the details of the above-described embodiment representing only one of the advantageous applications of the invention.

I claim:

1. A method for winding and slitting a paper web in a papermaking line, comprising the steps of:

dividing a web longitudinally into a plurality of slit webs of first selected widths;

winding the slit webs about roll centers, to form rolls at a winding station;

periodically cutting the web in a cross machine direction with a web-severing device in conjunction with a roll set change on the winding station, wherein the improvement comprising:

slitting the web with a first slitter assembly adjusted to the first selected widths, while a second slitter assembly is adjusted into second selected slitting width positions which are different than the first selected widths, followed by cutting the web in the cross machine direction with the web-severing device, followed by slitting the web with the second slitter assembly, while the first slitter assembly is adjusted into alternative selected slitting width positions.

2. The method of claim 1, wherein in the first slitting assembly and the second slitting assembly are disposed in succession along the travel direction of the web.

3. The method of claim 1 wherein, during the roll set change of the winding operation, the first slitter assembly is driven into an open position in order to produce a desired length of full-width web, after which the second slitter assembly is driven into a slitting position in order to divide the web into slit webs.

4. The method of claim 3 wherein the periodic cutting of the web in the cross machine direction is obliquely to the web travel direction at an area of the desire length of fill-width web.

5. The method of claim 1 wherein, prior to the roll set change at a first winding station, the slit webs are wound into finished rolls and a second winding station is prepared for winding by inserting new roll centers in place and driving the winding station to a synchronous speed with the speed of the web.

6. The method of claim 1 wherein, the step of periodically cutting the web includes the operation of using the web-severing device to apply glue or similar adhesive to an area of the full-width length of the web, close to the severing point of the web, in order to attach a tail of the web to the roll centers at the winding station.

7. The method of claim 1, wherein the web is passed from the papermaking machine to the winding station via a drawing nip formed by two rolls.

8. An apparatus in a papermaking line for slitting and winding a paper web comprising:

a paper web, defining a direction of travel, extending through a first adjustable slitter assembly set to produce a plurality of first slit webs of first selected widths, a second adjustable slitter assembly set to produce a plurality of second slit webs of second selected widths, which differ from the first selected widths, a web-severing device, and a first winder station having a first plurality of roll centers corresponding to the first slit webs of the first selected widths and a second winder station having a second plurality of roll centers corresponding to the second slit webs of the second selected widths, the first winder station and the second winder station being arranged to alternate so as to receive corresponding first slit webs of the first selected widths on the first plurality of roll centers in the first winder station and second slit webs of the second selected widths on the second plurality of roll centers in the second winder station, wherein the first adjustable slitter assembly and the second adjustable slitter assembly are arranged to alternate in cutting the web, and each of the first slitter assembly, and the second slitter assembly being adjustable, when not cutting the web, to vary the web slit widths.

9. The apparatus of claim 8, wherein said web-severing device is adapted to cut the web obliquely to the web travel direction.

10. The apparatus of claim 8, wherein said web-severing device includes means for applying glue or similar adhesive close to a severing point of the web in order to attach a tail of the web to the roll centers.

11. The apparatus of claim 8, wherein the first adjustable slitter assembly and the second adjustable slitter assembly are disposed in succession along the travel direction of the web.

12. The apparatus of claim 8 further comprising a drawing nip for passing the web from the preceding apparatus to the first adjustable slitter assembly and the second adjustable slitter assembly, the drawing nip for keeping a proper tension of the running web at the web's delivery from said preceding processing step.

13. A method for winding and slitting a paper web in a papermaking line, comprising the steps of:

alternately slitting a moving web, which defines a travel direction, with a first slitter assembly to divide the web longitudinally into a first plurality of slit webs of first selected widths, and winding said first plurality of slit webs onto a first plurality of winding cores of first selected widths, and simultaneously adjusting a second slitter assembly into a second selected slitting width position followed by;

cutting the web in the cross machine direction with a web-severing device in conjunction with a roll set change on a winding station which receives the web from the slitter assemblies, followed by slitting the web with the second slitter assembly and winding said second plurality of slit webs onto a second plurality of winding cores of second selected widths.

14. The method of claim 13 wherein the first slitting assembly and the second slitting assembly are disposed in succession along the travel direction of the web.

15. The method of claim 13 wherein, during the roll set change of the winding operation, the first slitter assembly is driven into an open position in order to produce a desired length of full-width web, after which the second slitter assembly is driven into a slitting position in order to divide the web into slit webs.

16. A method for winding and slitting a paper web in a papermaking line, comprising the steps of:

dividing a web longitudinally into a plurality of slit webs of first selected widths;

winding the slit webs about roll centers, to form rolls at a winding station;

periodically cutting the web in a cress machine direction with a web-severing device in conjunction with a roll set change on the winding station, wherein the improvement comprises:

slitting the web with a first slitter assembly adjusted to the first selected widths, while a second slitter assembly is adjusted into second selected slitting width positions which are different than the first selected widths, followed by cutting the web in the cross machine direction with the web-severing device, followed by slitting the web with the second slitter assembly, while the first slitter assembly is adjusted into alternative selected slitting width positions; and wherein, during the roll set change of the winding operation, the first slitter assembly is driven into an open position in order to produce a desired length of full-width web followed by the step of using the web-serving device to apply glue or similar adhesive to an area of the full-width web, after which the second slitter assembly is driven into a slitting position in order to divide the web into slit webs.

* * * * *